US011795743B2

(12) United States Patent
Sellar

(10) Patent No.: US 11,795,743 B2
(45) Date of Patent: Oct. 24, 2023

(54) SECURITY DEVICE

(71) Applicant: Fantom Hardware Pty Ltd, Eastwood SA (AU)

(72) Inventor: Mark Andrew Sellar, Port Adelaide (AU)

(73) Assignee: Fantom Hardware Pty Ltd, Eastwood SA (AU)

( * ) Notice: Subject to any disclaimer, the term of this patent is extended or adjusted under 35 U.S.C. 154(b) by 113 days.

(21) Appl. No.: 17/052,032

(22) PCT Filed: May 6, 2019

(86) PCT No.: PCT/AU2019/050413
§ 371 (c)(1),
(2) Date: Oct. 30, 2020

(87) PCT Pub. No.: WO2019/210374
PCT Pub. Date: Nov. 7, 2019

(65) Prior Publication Data

US 2021/0115713 A1 Apr. 22, 2021

(30) Foreign Application Priority Data

May 4, 2018 (AU) ..... 2018901521

(51) Int. Cl.
*E05C 19/16* (2006.01)
*E05C 1/00* (2006.01)
*E05C 1/08* (2006.01)

(52) U.S. Cl.
CPC ..... *E05C 19/163* (2013.01); *E05C 1/004* (2013.01); *E05C 1/085* (2013.01); *E05Y 2201/46* (2013.01); *E05Y 2900/132* (2013.01)

(58) Field of Classification Search
CPC . Y10T 292/1014; E05C 19/163; E05C 1/004; E05C 1/085; E05C 17/56;
(Continued)

(56) References Cited

U.S. PATENT DOCUMENTS 2,497,697 A * 2/1950 Smith ..... E05C 17/56 292/144
3,258,285 A * 6/1966 Smith ..... E05C 17/56 292/251.5
(Continued)

FOREIGN PATENT DOCUMENTS

AU 465866 B2 10/1975
CN 101037912 A * 9/2007 ..... E05C 17/56
(Continued)

OTHER PUBLICATIONS

"International Application No. PCT/AU2019/050413, International Preliminary Report on Patentability dated Apr. 17, 2020", (dated Apr. 17, 2020), 16 pgs.
(Continued)

*Primary Examiner* — Kristina R Fulton
*Assistant Examiner* — Steven A Tullia
(74) *Attorney, Agent, or Firm* — Schwegman Lundberg & Woessner, P.A.

(57) ABSTRACT

A security device for a door in a doorway. The device includes a floor-carriable portion and a door-carriable portion magnetically co-operable with the floor-carriable portion to stop the door opening past a communication position at which the door is positioned to guard the doorway and ajar to enable the communication via the doorway. At least one of the floor-carriable portion and the door-carriable portion is reconfigurable to allow the door to open past the communication position.

20 Claims, 3 Drawing Sheets

(58) Field of Classification Search
CPC ... E05C 19/16; E05C 19/168; E05Y 2201/46; E05Y 2900/132; Y10S 292/15
USPC ..... 292/137, 183
See application file for complete search history.

(56) References Cited

U.S. PATENT DOCUMENTS 3,539,214 A * 11/1970 Raymond ..... E05C 19/16 292/144
3,791,687 A 2/1974 Schroeder
4,401,346 A * 8/1983 Jones ..... E05C 19/168 292/144
4,872,286 A * 10/1989 Peirish ..... E05B 65/0829 292/201
5,082,317 A * 1/1992 Delaney, Jr. ..... E05C 17/56 292/DIG. 19
5,395,143 A * 3/1995 Chesterton ..... E05C 17/48 292/57
5,490,304 A * 2/1996 Winner, Jr. ..... E05F 5/06 16/82
5,531,490 A * 7/1996 Parker ..... E05C 19/184 292/262
5,590,918 A * 1/1997 Kambalov ..... E05C 19/003 16/82
6,321,411 B1 * 11/2001 Ikejiri ..... E05F 5/06 16/85
6,327,743 B1 * 12/2001 Rashid ..... E05C 17/04 16/86 A
6,471,264 B1 * 10/2002 Ryan ..... E05C 1/04 292/262
6,588,811 B1 * 7/2003 Ferguson ..... E05C 19/16 292/DIG. 19
8,403,382 B2 * 3/2013 Della-Santa ..... E05C 17/02 16/82
11,187,019 B2 * 11/2021 Sellar ..... E05C 17/56
2006/0242908 A1 * 11/2006 McKinney ..... E05F 15/73 49/280
2011/0049911 A1 * 3/2011 Bosshard ..... E05C 17/56 292/251.5
2015/0361707 A1 * 12/2015 Swanberg ..... E05F 5/06 16/83

FOREIGN PATENT DOCUMENTS

CN 202139939 U 2/2012
CN 112824634 A * 5/2021 ..... E05C 17/46
CN 113047714 A * 6/2021 ..... E05C 17/00
DE 19701905 A1 * 7/1998 ..... E05C 19/168
DE 102009035824 A1 * 2/2011 ..... E05C 17/48
EP 0953702 A1 * 4/1999 ..... E05C 19/003
EP 1950370 A1 * 7/2008 ..... E05C 17/56
EP 2154319 A2 * 2/2010 ..... E05C 17/56
EP 2154320 A2 2/2010
GB 2425569 A * 11/2006 ..... E05C 17/56
GB 2512582 A * 10/2014 ..... E05B 47/0012
JP 2000080855 A * 3/2000
JP 2003049574 A * 2/2003
JP 4483071 B2 * 6/2010 ..... E05C 17/56
KR 20160120003 A * 5/2015 ..... E05C 17/56
WO WO-2006114612 A1 11/2006
WO WO-2017117628 A1 7/2017
WO WO-2019210374 A9 12/2019

OTHER PUBLICATIONS

"International Application No. PCT/AU2019/050413, International Search Report and Written Opinion dated Jun. 17, 2019", (dated Jun. 17, 2019), 14 pgs.

* cited by examiner

SECURITY DEVICE

PRIORITY CLAIM TO RELATED APPLICATIONS

This application is a U.S. national stage filing under 35 U.S.C. § 371 from International Application No. PCT/AU2019/050413, filed on 6 May 2019, and published as WO2019/210374 on 7 Nov. 2019, which claims the benefit under 35 U.S.C. 119 to Australia Application No. 2018901521, filed on 4 May 2018, the benefit of priority of each of which is claimed herein, and which applications and publication are hereby incorporated herein by reference in their entirety.

FIELD

The invention relates to security devices and other hardware for doors.

BACKGROUND

A door chain is a well-known security device. A typical door chain includes a chain. One end of the chain is fixed by a bracket screwed in place on a door frame. The other end of the chain carries a feature selectively engageable with a slotted bracket screwed in place on the door.

The length of the chain is selected so that, when engaged with the bracket carried by the door, the chain serves to prevent the door opening past a communication position at which the door is positioned to guard the doorway whilst the door is ajar to enable communication via the doorway. Utilising a door chain, the door can be opened a short distance to provide a gap through which the occupant of a residence can talk to a visitor whilst the door, held in place by the chain, prevents the visitor from entering the premises until the chain is disengaged.

The present inventors have recognised that door chains are not infallible. With sufficient force applied to the door, the screws by which the chain is attached to the door frame can pull out of the door frame. Additionally, when the chain is working to stop the door at its communication position, the chain is readily accessible to be cut by an unwelcome visitor utilising a tool such as a bolt cutter.

For the sake of convenience to the user, door chains are typically mounted at about shoulder height where they can detract from the aesthetic of the interior of the door. The door chain adds to the other hardware items such as locks, doorknobs and doorstops which can be less than attractive.

With the foregoing in mind, the present invention aims to provide improvements in and for door security, or at least to provide an alternative for those concerned with door security.

The inventors have recognised that elements of their doorstops described in international patent application no. PCT/AU2017/050007 (published as WO 2017/117628 A1) can be utilised to produce an advantageous door security device. The content of publication WO 2017/117628 A1 is incorporated herein by reference. The interested reader is directed to that document for further information.

It is not admitted that WO 2017/117628 A1 is common general knowledge.

SUMMARY

One aspect of the invention provides a security device, for a door in a doorway, including a floor-carriable portion; and a door-carriable portion magnetically co-operable with the floor-carriable portion to stop the door opening past a communication position at which the door is positioned to guard the doorway and ajar to enable the communication via the doorway;

at least one of the floor-carriable portion and the door-carriable portion being reconfigurable to allow the door to open past the communication position.

Preferably the door-carriable portion includes an operative portion and a mounting arrangement by which the operative portion is mountable to move relative to the door such that the door-carriable portion is reconfigurable, to allow the door to open past the communication position, by moving the operative portion relative to the door.

Preferably the mounting arrangement is configured to enable the operative portion to move parallel to the door and/or to move horizontally.

The floor-carriable portion may include a blocking member. The magnetic co-operation may be to lift the blocking member to a blocking position to stop the door opening past the communication position. The blocking member may be an upright pin.

The floor-carriable portion and the door-carriable portion are preferably co-operable to hold the door in the communication position.

A preferred embodiment includes a further floor-carriable portion magnetically co-operable with the door-carriable portion to stop the door opening past an open position beyond the communication position. The further floor-carriable portion may be substantially identical to the floor-carriable portion. The further floor-carriable portion and the door-carriable portion are preferably co-operable to hold the door in the open position.

Another aspect of the invention provides an access point including the device, the door and the doorway.

Another aspect of the invention provides the use of the device to stop the door opening past the communication position.

Another aspect of the invention provides a floor-carriable portion, for a door stop, comprising a guide-sleeve; and a pin configured to slide within the guide sleeve and magnetically co-operable, with a door-carriable portion of the door stop, to be lifted to a blocking position to stop a door; one or both of the guide-sleeve and the pin being shaped to vent a bottom of the guide-sleeve to a top of the guide-sleeve.

Preferably an interior of the guide sleeve and an exterior of the pin have mutually different cross-sections to vent a bottom of the guide sleeve to a top of the guide sleeve.

The exterior of the pin may be substantially cylindrical. The guide sleeve may be shaped to define a well under pin. The pin and guide sleeve may have complementary stop portions abutable to stop the pin falling into the well. Optionally the complementary stop portions comprise a projection projecting upwardly from a bottom of the well and an underside of the pin.

DESCRIPTION OF EMBODIMENTS

Figure 1:
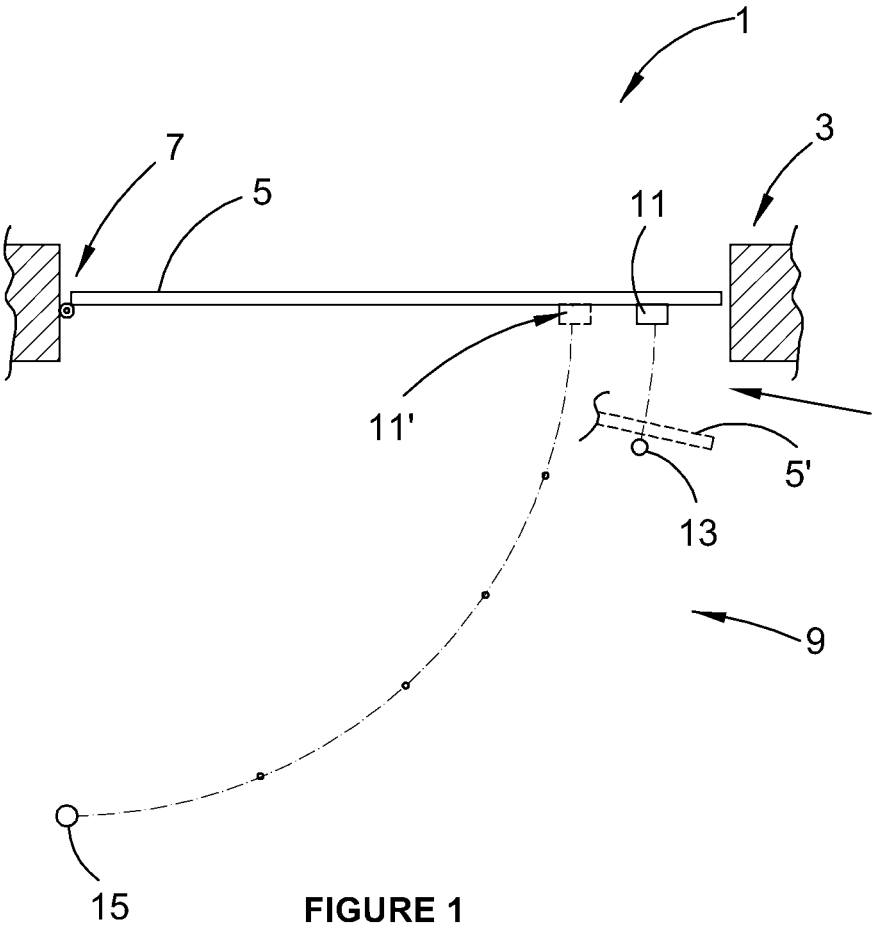
FIG. 1 is a plan view of an access point.

FIG. 1 illustrates an access point 1, such as the entrance to a family home. The access point incorporates a doorway 3 defined by a doorframe framing the door 5. The door 5 is a swing door and as such is pivotally mounted by the hinge 7 to the doorway 3 to pivot about an upright axis. Other variants of the access point may take the form of a sliding door.

The access point 1 further includes a security device 9 incorporating a door-carriable portion 11 and floor-carriable portions 13, 15.

Figure 2:
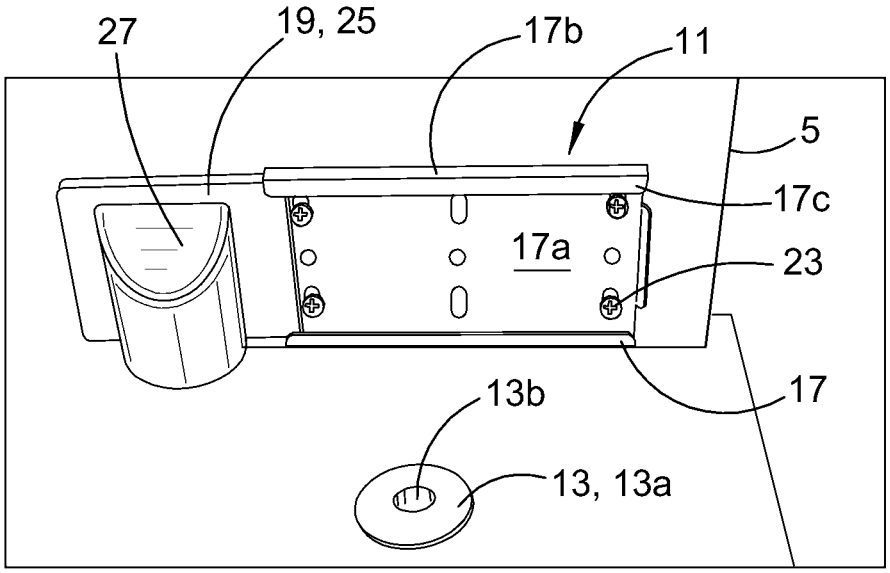
FIG. 2 is a perspective view of an assembly step.
Figure 3:
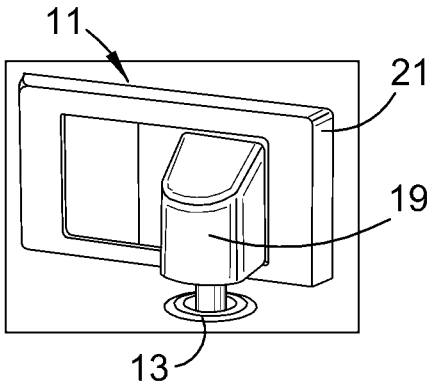
FIG. 3 is a perspective view of a security device configured for communication.
Figure 4:
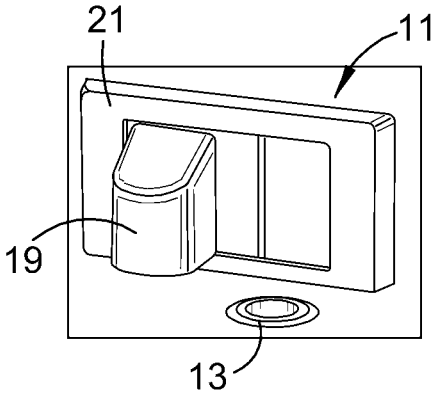
FIG. 4 is a perspective view of the security device configured to enable the door to open.

Turning to FIGS. 2 to 4, the door-carriable portion 11 incorporates a mounting bracket 17, operative portion 19 and a fascia 21.

The mounting bracket 17 takes the form of an elongate channel incorporating a base 17*a* bracketed by a pair of side walls 17*b*. Each of the walls 17*b* has a respective flange 17*c* inwardly directed to overlie the base 17*a*. In this example, the bracket 17 is metallic and substantially consists of a single piece of material.

The base 17*a* is punctuated by an array of screw holes by which the bracket is fastenable, to an interior face of the door, adjacent a lower edge of the door and proximal to the free edge of the door distal to the hinge 7. In this example, the mounting bracket is fastened to the door with the aid of four screws 23. Other fastening arrangements are possible. Indeed, other mounting arrangements are possible, e.g. the bracket 17 might be replaced with a suitable arrangement of features integral to the skin of the door.

The operative portion 19 includes features co-operable with the portions fixed to the door. In this example, the portion 19 includes a rectangular-plate-like backing portion 25 dimensioned for receipt between the walls 17*b* and to be captured between the base 17*a* and the flanges 17*c*. The portion 19 is thus configured to slide along the bracket 17.

The operative portion 19 further includes a body portion 27 that extends forwardly from the backing portion 25.

The fascia 21 incorporates an elongate opening to accommodate the body 27 and is shaped to clip onto the mounting bracket 17 whereby the operative portion 19 is captured on the door 5 whilst being permitted to slide horizontally along the door to differing radii from the hinge 17.

In this example, the bracket 17 and fascia 21 together constitute the static portions of the door-carriable portion whilst the operative portion 19 constitutes a movable portion of the door-carriable portion 11. The static portions and the movable portion are preferably configured to frictionally engage each other when the movable portion is at the communication position, and preferably also when the movable portion is at the opening position. One implementation of the concept, entails a respective small rectangular plate at each end of the bracket 17 and into which the screws 23 are countersunk. Corresponding small rectangular plates are siliconed (or otherwise resiliently adhered) to the interior of the fascia 21. The backing plate 25 of the operative portion 19 is thus sandwiched between a pair of small steel plates at each of its stroke. The small rectangular plates are steel plates magnetically co-operable with the magnet of the operative portion 19. Thus, the pair of plates at each end of the operative portion 19 together with the operative portion 19 constitutes a magnetic holding-arrangement for holding the operative portion at the user selected position. The benefits are twofold. Firstly, holding the operative portion in this way suppresses rattling that might otherwise occur. Secondly, the holding arrangement serves to resist inadvertent movement of the operative portion.

The small rectangular plates are but one example of magnetically co-operable material that might be arranged to form part of a magnetic holding arrangement. Indeed, other forms of holding arrangements are possible. By way of example, the door-carriable portion may include a detent mechanism, such as a ball detent mechanism, such that the operative portion clicks into position.

The floor-carriable portion 13 incorporates a fixed sleeve 13*a* and stainless steel pin 13*b*. The sleeve 13*a* has a radial flange encircling its upper end, which flange outwardly tapers to present a negligible tripping hazard when mounted in the floor.

The pin 13*b* is a cylindrical pin mounted to slide within an upwardly open cylindrical bore of the sleeve 13*a*.

The operative portion 19, or more specifically its body 27, carries a magnet magnetically co-operable with the pin 13*b*.

As the words are used herein, a magnet is an item capable of magnetically attracting certain other materials, that attraction is referred to as magnetic co-operation, and each of the magnet and the certain other materials is said to be a magnetically co-operable material.

Other magnetically co-operable arrangements are possible, e.g. the pin 13*b* may be a magnetic pin co-operable with a stainless steel operative portion 19.

The bracket 17*a*, fascia 21 and backing plate 25 constitute a mounting arrangement by which the operative portion 19 is mounted to move relative to the door. FIG. 3 shows the operative portion 19 slid to the right-hand side of the opening of the fascia 21. Thus, the operative portion 19 is positioned, and the door-carriable portion 11 is configured, to co-operate with the floor-mountable portion 13.

Returning to FIG. 1, the floor-mountable portion 13 is positioned a short distance inward (i.e. into the interior of the building accessible via the access point 1). When the door is opened inwardly, the portions 11, 13 magnetically co-operate to lift the pin 13*b* to serve as a blocking member. The blocking member engages a stop portion of the door-carriable portion 11, e.g. on an underside of the body 27. The upright edge of the door remote from the hinge 7 is illustrated in its communication position in phantom lines 5' in FIG. 1. At this position, a gap between the door and the doorway is defined to enable individuals on opposite sides of the door 5 to converse and potentially exchange small items such as letters.

The floor-carriable portion 13 is positioned to limit the opening of the door to prevent an unwelcome visitor entering via the access point 1, i.e. so that the door guards the doorway.

FIG. 3 illustrates the door-carriable portion 11 in its communication/door-guarding configuration. FIG. 4 illustrates that portion in its door-opening configuration to enable the door to open and corresponding to door-carriable portion 11' in FIG. 1.

When the door-carriable portion 11/11' is in its door-opening configuration, the operative portion 19 is positioned to bypass the door-guarding floor-carriable portion 13. In this example of the device 9, a further floor-carriable portion 15 is provided which advantageously may be substantially identical to the floor-carriable portion 13. The floor-carriable portion 15 is positioned to co-operate with the door-carriable portion 11 (in its door-opening configuration of FIGS. 4 and 11') to limit the opening of the door, e.g. to protect an adjacent wall.

Preferred variants of the door-carriable portion 11 incorporate a detent arrangement by which the operative portion 19 clicks into place at its respective communication and opening positions.

Some variants of the described device may be suited to hold the door in its communication and open positions. For this purpose, and underside of the operative portion 19 may have a socket into which the pin 13*b* is receivable.

For other applications, such as fire doors that should not be held open, the security device 9 may be configured to limit movement beyond the communication and open positions without holding the door at those positions. For this purpose, an underside of the operative portion 19 may present a surface that is configured to slide over the pin 13*b* so as to present negligible resistance to the door-closing device. This surface may be inclined. Fire rated versions of the device 9 are contemplated.

The invention is not limited to the described example. Rather the invention is defined by the claims.

In the illustrated example the operative portion 19 is mounted to slide horizontally along the bottom of a swing door to reconfigure the door-carriable portion. Movement in other directions is possible, e.g. the operative portion 19 might be lifted to avoid lifting the pin 13*b* and thereby enable the door to open past the communication position. On a sliding door the operative portion might be mounted to move normal to the plane of the door. Indeed, entirely different modes of reconfiguration are possible. By way of example, the operative portion 19 might be rigidly fixed to the door and the device 9 made reconfigurable by the inclusion of a floor-mounted latch to hold down the pin 13*b* to enable the door to pass the communication position.

The pin 13*b* is but one example of a potential blocking portion. The blocking portion could take the form of a floor-mounted flap.

Figure 5:
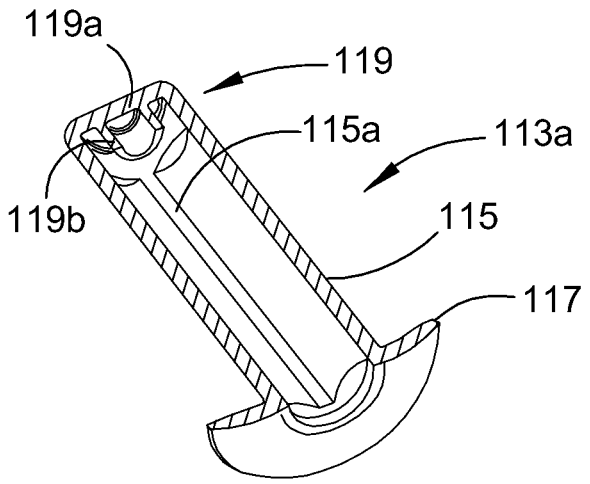
FIG. 5 is an axial cross-section view of a guide sleeve.
Figure 6:
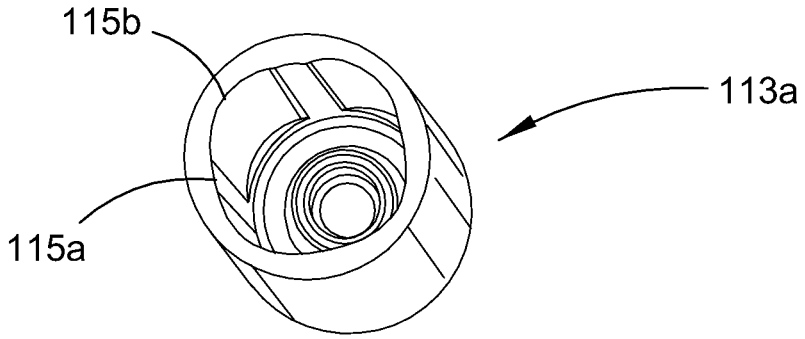
FIG. 6 is a transverse cut-away view looking down at the bottom of the guide sleeve of FIG. 5.
Figure 7:
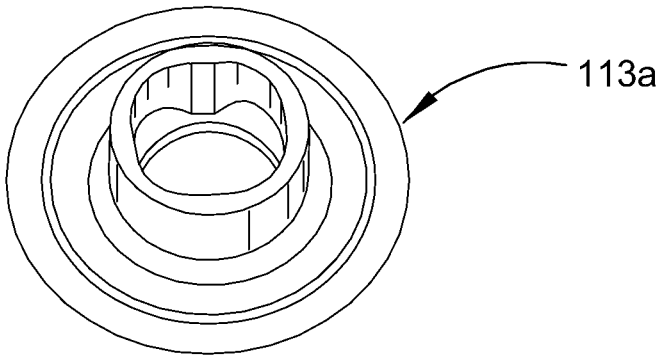
FIG. 7 is a transverse cut-away view looking down on the top of the guide sleeve of FIG. 5 when inverted.

FIGS. 5 to 7 illustrate a preferred guide sleeve 113*a* comprising a tubular body 115 and a flanged head 117. The sleeve 113*a* is configured to sit within a suitable hole in the floor, e.g. to sit in a hole drilled into a concrete floor, so that its flanged head 117 sits just above the floor height. The tapered profile of the flanged head minimises any tripping hazard imposed.

The guide sleeve 113*a* is configured to receive a blocking pin with a loose sliding fit whereby the pin is free to slide upwards when magnetically attracted to the door-carriable portion. The interior of the sleeve 113*a* has a vertical length and a non-circular profile over most of that length. In this particular example the cross-section includes a circular array of four pin contacting portions 115*a* for contacting and vertically guiding a cylindrical pin. The pin guiding portions 115*a* are separated by set-back portions 115*b*. In this example the set back portion 115*b* are smaller radii portions eccentric to the contacting portions 115*a*.

When the pin (dimensioned from a closing siding fit with the portions 115*a*) is in place each of the portions 115*b* defines a respective crescent-shaped vent by which a bottom of the sleeve 113*a* is vented to the top of the sleeve 113*a*.

The bottom of the sleeve 113*a* is closed so as to define a well 119 for holding moisture and debris. In this example the well has a disc-like base 119*a* from which a tubular boss 119 projects upwardly. The boss 119*b* constitutes a stop for abutting the underside of the pin to stop the pin falling into the well 119.

The present inventors have recognised that the accumulation of moisture and debris within a conformally-fitting guide sleeve can lead to the pin sticking and thereby impede the function of the door stop.

The well 119 provides space for a small amount of moisture and/or debris to sit below the pin without impeding the pin's operation. At the same time the crescent-shape vents (defined by the setback portions 115*b*) allow the moisture to escape over time thereby reducing the frequency with which the sleeve 113*a* should be cleaned and dried.

Many variations on these concepts are possible. By way of example, the stop 119*b* might be replaced by a slender downward projection on the underside of the pin or some other form of complementary stop formation, e.g. higher up on the pin/sleeve combination.

In this example, the pin has a cylindrical exterior whilst the interior of the sleeve 113*a* has a different shape to provide venting. Another option might entail a cylindrical sleeve in combination with a non-cylindrical pin. Indeed the pin might be hollow to provide venting and/or the sleeve 113*a* could be a more elaborate structure with a vent path separate from the main bore of the sleeve. The sleeve 113*a* includes venting and a well in combination although these features may be separately useful, e.g. vents may be useful for drying out the drilled hole in the concrete floor in the context of an open-ended guide sleeve.

In the described example, the magnetic co-operation upwardly draws the pin 13*b*. In other examples the magnetic co-operation may downwardly draw a blocking portion from the door-carriable portion, e.g. downwardly draw a blocking portion against a spring bias by which that blocking portion is otherwise held up.

The access point 1 could be an interior door, e.g. the doorway to a bedroom. This would allow a sleeper to leave a door open for fresh air and/or to allow pets to enter whilst providing an additional degree of security if an intruder finds their way into the home.

The invention claimed is:

1. A security device, for a door in a doorway, comprising:
a floor-carriable portion comprising a blocking member;
a door-carriable portion comprising:
an operative portion, and
a mounting arrangement by which the operative portion is mountable to move, to differing radii relative to an axis of a hinge of the door, between:
a first position where the operable portion interfaces with and is configured to magnetically co-operate with the floor-carriable portion to lift the blocking member, to a blocking position, to act as a stop for the door in a communication position to stop the door opening past the communication position and
a second position where the door-carriable portion is offset from the floor-carriable portion to allow the door to open past the communication position; and
a further floor-carriable portion
configured to magnetically cooperate with the operative portion in the second position to stop the door opening past an open position beyond the communication position.

2. The device of claim 1 wherein the mounting arrangement is configured to enable the operative portion to move horizontally relative to the door.

3. The device of claim 1 wherein the mounting arrangement is configured to enable the operative portion to move parallel to the door.

4. The device of claim 1 wherein the blocking member is a pin.

5. The device of claim 4 wherein the floor-carriable portion comprises a guide sleeve for the pin to slide within for the lifting to the blocking position.

6. The device of claim 5 wherein an interior of the guide sleeve and an exterior of the pin have mutually different cross-sections to vent a bottom of the guide sleeve to a top of the guide sleeve.

7. The device of claim 5 wherein the guide sleeve is shaped to define a well under pin, and the pin and guide sleeve have complementary stop portions abutable to stop the pin falling into the well.

8. The device of claim 1 wherein the floor-carriable portion and the door-carriable portion are co-operable to hold the door in the communication position.

9. The device of claim 1 wherein the further floor-carriable portion is substantially identical to the floor-carriable portion.

10. The device of claim 1 wherein the further floor-carriable portion and the door-carriable portion are co-operable to hold the door in the open position.

11. An access point comprising:
the device of claim 1;
the door; and
the doorway.

12. A method of stopping a door of a doorway opening past a communication position at which the door is:
positioned to guard the doorway; and
ajar to enable the communication via the doorway,
the method comprising using a security device, the security device comprising:
a floor-carriable portion comprising a blocking member;
a door-carriable portion; and
a further floor-carriable portion;
wherein a door-carriable portion comprises:
an operative portion, and
a mounting arrangement by which the operative portion is mountable to move, to differing radii relative to an axis of a hinge of the door, between
a first position where the operable portion interfaces with and is configured to magnetically co-operate with the floor-carriable portion to lift the blocking member, to a blocking position, to act as a stop for the door in the communication position to stop the door opening past the communication position and
a second position where the door-carriable portion is offset from the floor-carriable portion to allow the door to open past the communication position; and
the further floor-carriable portion is magnetically co-operable with the operative portion in the second position to stop the door opening past an open position beyond the communication position.

13. A security device for a door in a doorway, the device comprising:
a floor-carriable portion; and
a door-carriable portion comprising:
an operative portion magnetically co-operable with the floor-carriable portion to limit opening of the door to stop the door opening past a communication position at which the door is:
positioned to guard the doorway; and
ajar to enable communication via the doorway; and
a mounting arrangement by which the operative portion is mountable to move, to differing radii relative to an axis of a hinge of the door, between
a first position where the operable portion interfaces with and is configured to magnetically co-operate with the floor-carriable portion to lift a blocking member, to a blocking position, to act as a stop for the door in the communication position to stop the door opening past the communication position and
a second position where the door-carriable portion is offset from the floor-carriable portion to allow the door to open past the communication position.

14. The device of claim 13 wherein the mounting arrangement is configured to enable the operative portion to move parallel to the door.

15. The device of claim 13 wherein:
the floor-carriable portion comprises a blocking member; and
the magnetic co-operation lifts the blocking member to a blocking position to stop the door opening past the communication position.

16. The device of claim 15 wherein the blocking member is a pin.

17. The device of claim 16 wherein the floor-carriable portion comprises a guide sleeve for the pin to slide within for the lifting to the blocking position.

18. The device of claim 17 wherein an interior of the guide sleeve and an exterior of the pin have mutually different cross-sections to vent a bottom of the guide sleeve to a top of the guide sleeve.

19. The device of claim 13 wherein the floor-carriable portion and the door-carriable portion are co-operable to hold the door in the communication position.

20. The device of claim 1 wherein the mounting arrangement comprises a bracket along which the operable portion slides.

* * * * *